United States Patent [19]

Berndt, Jr.

[11] Patent Number: 4,675,222

[45] Date of Patent: Jun. 23, 1987

[54] FLOOR COVERING CONNECTING AND SUPPORTING STRUCTURE

[75] Inventor: Fred P. Berndt, Jr., Arden Hills, Minn.

[73] Assignee: Reese Enterprises, Inc., Rosemount, Minn.

[21] Appl. No.: 880,146

[22] Filed: Jun. 30, 1986

[51] Int. Cl.[4] ..... B32B 3/06

[52] U.S. Cl. ..... 428/53; 428/54; 428/61; 428/62; 52/181; 52/586; 15/217

[58] Field of Search ..... 428/53, 54, 52, 61, 428/62; 15/215-217; 52/181, 586, 585

[56] References Cited

U.S. PATENT DOCUMENTS

| | | | |
|---|---|---|---|
| Re. 32,061 | 1/1986 | Ellingson | 428/52 |
| 3,808,628 | 5/1974 | Betts | 15/215 |
| 3,909,996 | 10/1975 | Ettlinger, Jr. | 52/177 |
| 4,029,834 | 6/1977 | Bartlett | 428/62 |
| 4,381,324 | 4/1983 | Ellingson | 428/58 |
| 4,568,587 | 2/1986 | Balzer | 428/52 |
| 4,590,110 | 5/1986 | Arens | 428/53 |

*Primary Examiner*—Alexander S. Thomas
*Attorney, Agent, or Firm*—Leo Gregory

[57] ABSTRACT

A connecting structure for sections of floor coverings such as of floor covering use in public walking areas, the connecting structure having longitudinal transversely spaced upstanding T members adapted to be retained in accomodating side vertical openings of the adjacent edge portions of floor covering sections for connection of the sections and being sufficiently flexible to bend along a longitudinal axis for a roll up of adjacent sections.

5 Claims, 4 Drawing Figures

FLOOR COVERING CONNECTING AND SUPPORTING STRUCTURE

BACKGROUND OF THE INVENTION

1. Field of Invention.

This invention relates to coupling structures for connecting adjacent sections of floor coverings.

2. Description of the Prior Art.

It is a common practice to provide floor coverings for public walking areas such as in office buildings. It is desirable to have floor covering sections connected in such a manner that they may be rolled up for cleaning purposes.

A prior art structure is disclosed in U.S. Pat. No. 4,029,384 issued June 14, 1977 to G. F. Bartlett wherein spaced rails form the portions of a mat and the same being coupled by rotatably engaged coupling members.

In U.S. Pat. No. 3,808,628 dated May 7, 1974 to Kenneth H. Belts, rigid elongated rails are shown joined together by flexible strips having projecting ears fitting into and being retained by adjacent slots of said rails.

U.S. Pat. No. Re. 32,061 dated Jan. 7, 1986 and issued to Chester W. Ellingson, Jr. discloses a coupling member having a web separating a pair of rod members for rotatable engagement of an adjacent pair of floor covering sections.

SUMMARY OF THE INVENTION

The invention herein relates to a connecting structure to couple adjacent floor covering sections and permit such sections to be rolled up for cleaning purposes.

More specifically it is an object of the connecting structure herein to comprise a flexible base having a pair of upstanding longitudinal T-shaped or T members, said structure being bendable along a longitudinal axis intermediate said members, said members being receivable into accomodating means of adjacent floor covering sections to connect and permit a roll up of such sections.

In view of the above object, it is a further object of said structure to underlie adjacent floor covering sections to provide a base support for the same.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
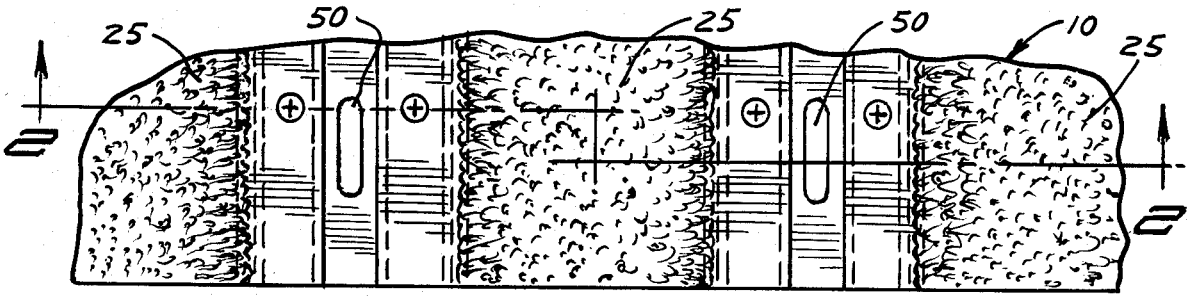
FIG. 1 is a broken view in plan.
Figure 3:
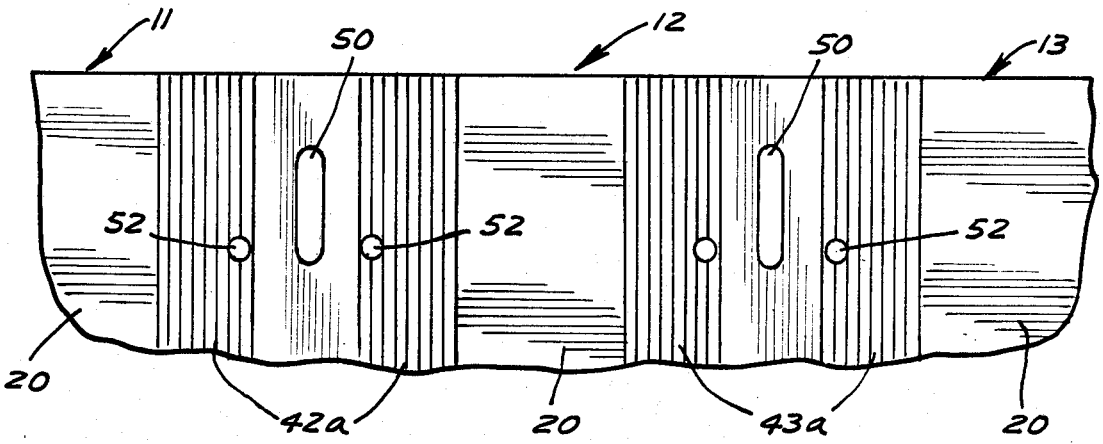
FIG. 3 is a broken view in plan taken on line 3—3 of FIG. 2 as indicated.

Referring to the drawings, a broken area of floor covering structure 10 is shown in plan in FIGS. 1 and 3 comprising interconnected floor covering sections 11, 12 and 13 which include connecting members or structures 15 and 16. Connecting member 15 is shown in perspective in FIG. 4.

The section 12 and the connecting member 15 will be described in detail and will be representative of the other respective floor covering sections and connecting members. Like reference numerals will indicate like parts in counterparts.

Said section 12 is conveniently formed by extrusion and preferably of a rigid material such as of a suitable plastic material. The B. F. Goodrich Company provides very suitable rigid plastic material known in the trade as FIBERLOC. This material is designed to provide high strength and stiffness, excellent dimensional stability, high resistance to wear and deterioration and low thermal expansion.

Figure 2:
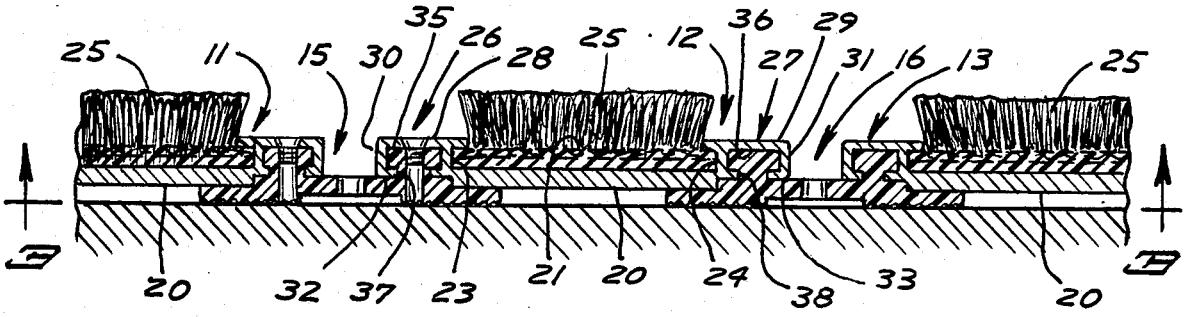
FIG. 2 is a view in vertical section taken on line 2—2 of FIG. 1 as indicated.

Referring to FIG. 2, the floor covering section 12 comprises a main body portion 20 having a central longitudinal recess or channel 21 therein having opposed facing grooves 23 and 24 to receive and retain a tread insert 25 such as made of a suitable carpeting strips for a walking surface.

Said main body portion has a shoulder portion 26 at one side thereof coextensive therewith and a like shoulder portion 27 at the other side thereof. Said shoulder portions extend and project laterally outwardly at each side of said main body portion whereby said shoulders have top walls 28 and 29, outer side walls 30 and 31 and bottom walls 32 and 33. Extending through said shoulders are bores or passages 35 and 36 shown to be rectangular in cross section having slots 37 and 38 extending through said bottom walls 32 and 33.

Figure 4:
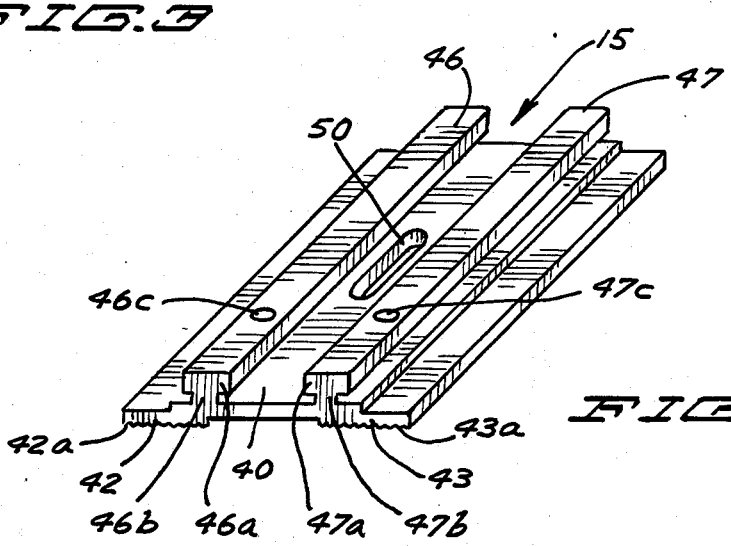
FIG. 4 is a view in perspective of the structure comprising the invention herein.

The connecting or coupling structure 15 will next be described. Referring to FIG. 4, said connecting structure 15 comprises a web 40. Offset laterally from said web stepped down therefrom at each side thereof are base supporting members 42 and 43. Spaced inwardly from each side of said web and upstanding therefrom in parallel arrangement are T members 46 and 47. Said T members have upper or head portions **46*a* and 47*a* and neck portions 46*b* and 47*b*. The head portions are sized to fit nicely into said bores 35 and 36**. Although said bores and T heads are shown to be rectangular in cross section, they may have other cross section configurations such that will permit no relative rotation between the two.

Said web 40 will have longitudinally spaced drain holes 50 therein.

Said connecting member 15 is shown in operating position in FIG. 2 connecting the sections 11 and 12. The slots 37 and 38 are of a width and height to accomodate the neck portions **46*b* and 47*b***.

The base supporting members 42 and 43, as shown in FIG. 2 underlie and support the adjacent bottom wall portions of the connected floor covering sections.

To prevent relative longitudinal movement, flush headed screws 52 at spaced intervals are disposed through said top walls 28 and 29 to be threaded into said T members as at **46*c* and 47*c***.

The connecting member 15 is preferably formed of a durable plastic material having such flexibility as to permit a folding along a longitudinal axis of its web for a roll up of the connected floor sections as for cleaning purposes. The durometer of the material of said connecting member is such as to make a noisless connection with the connected floor covering sections and to provide a noisless supporting base.

It will of course be understood that various changes may be made in form, details, arrangement and proportions of the parts without departing from the scope of the invention herein which, generally stated, consists in an apparatus capable of carrying out the objects set forth, in the parts and combination of parts disclosed and defined in the appended claims.

What is claimed is:

1. A connecting structure for floor covering sections having in combination, a floor covering section substantially rectangular in plan, a shoulder at each side of said section, a longitudinal non-round bore through each of said shoulders, said shoulders each having a bottom wall, slots coextensive with said bores through each of said bottom walls, a connecting member comprising a web and having an upstanding T member along each side thereof, said T members respectively having head and neck portions, said head portions being received into said bores and have no relative rotative movement therebetween, said neck portions extending through said slots, and a lateral extension at each side of said web underlying and supporting the adjacent portions of said floor covering sections.

2. The structure of claim 1, wherein said floor covering section includes a longitudinal recess between said shoulders, a groove at each side of said recess, said grooves having opposed open sides, and a tread strip disposed into said recess and extending into said grooves.

3. The structure of claim 1, including means securing said T members and said shoulders preventing relative axial movement therebetween.

4. The structure of claim 1, wherein said shoulders are substantially rectangular in cross section.

5. The structure of claim 1, wherein said bores are substantially rectangular in cross section.

* * * * *